US010378698B1

(12) United States Patent
McEllen et al.

(10) Patent No.: US 10,378,698 B1
(45) Date of Patent: Aug. 13, 2019

(54) METHOD AND ADAPTOR FOR CONVERTING A PORTABLE HARP SYSTEM LAMP WITH A SINGLE UP-SOCKET TO A PLURAL DOWN-SOCKET LED LIGHTING SYSTEM

(71) Applicant: MYLIGHT LLC, Georgetown, SC (US)

(72) Inventors: John McEllen, Chagn Falls, OH (US); L Lawton Rogers, III, Georgetown, SC (US)

( * ) Notice: Subject to any disclaimer, the term of this patent is extended or adjusted under 35 U.S.C. 154(b) by 0 days.

(21) Appl. No.: 16/268,878

(22) Filed: Feb. 6, 2019

(51) Int. Cl.
*F21K 9/232* (2016.01)
*F21V 29/70* (2015.01)
*F21V 19/00* (2006.01)

(52) U.S. Cl.
CPC ..... *F21K 9/232* (2016.08); *F21V 19/001* (2013.01); *F21V 19/0055* (2013.01); *F21V 29/70* (2015.01)

(58) Field of Classification Search
CPC ..... F21S 6/002; F21S 6/003; F21K 9/232; F21V 19/005; F21V 19/001; F21V 19/0015
USPC ..... 362/417
See application file for complete search history.

(56) References Cited

U.S. PATENT DOCUMENTS

| | | | | |
|---|---|---|---|---|
| 9,388,946 | B1 * | 7/2016 | Stagni | F21K 9/232 |
| 9,416,922 | B1 * | 8/2016 | Stagni | H05B 33/0845 |
| 9,829,163 | B1 * | 11/2017 | Stagni | H05B 33/0845 |
| 2012/0236569 | A1 * | 9/2012 | Chang | F21V 3/02 362/294 |
| 2013/0063935 | A1 * | 3/2013 | Thrailkill | F21V 29/004 362/231 |
| 2017/0153017 | A1 * | 6/2017 | Benner | F21V 33/00 |

* cited by examiner

*Primary Examiner* — William N Harris

(57) ABSTRACT

An adaptor for manually converting a conventional portable lamp with a harp supported shade from (a) a single Edison up-socket adapted to receive an Edison-based, base-down, incandescent, compact florescent or LED light bulb to (b) a plural down-socket LED lighting system with materially increased task lighting, where the rapid conversion does not require the use of tools or any special skills, does not require any modification of the wiring of the conventional lamp, and does not change the aesthetics of the lamp. Methods of making the conversion are disclosed that do and do not require the removal of the harp during the conversion.

33 Claims, 6 Drawing Sheets

METHOD AND ADAPTOR FOR CONVERTING A PORTABLE HARP SYSTEM LAMP WITH A SINGLE UP-SOCKET TO A PLURAL DOWN-SOCKET LED LIGHTING SYSTEM

BACKGROUND OF THE INVENTION

The present invention relates generally to an adaptor for increasing the amount of task light available from portable table and floor harp system lamps now in service to offset the natural deterioration of eyesight with age.

More specifically, the present invention relates to an adaptor for the manual conversion of in-service portable floor and table harp system lamps from (a) a single female Edison screw socket adapted to receive an Edison-based, base-down, incandescent, compact florescent or LED light bulb to (b) a plural down-socket LED lighting system with materially increased and better task lighting, where the rapid conversion does not require any special skills or the use of tools, does not require any modification of the wiring of the conventional lamp, and does not change the aesthetics of the lamp.

Harp System Lamps.

It has been estimated that that there are over 500 million portable table and floor lamps in service in the United States and Canada, in homes, apartments, dormitories, offices, hotels, etc. Portable lamps have a base adapted to rest on a horizontal surface, a decorative cored body, and a decorative shade. While such lamps are generally purchased to provide light, the selection of the lamp actually purchased is almost entirely architectural, i.e., on the basis of the appearance of the lamp body and its shade. Lamp aesthetics is thus critical and includes, e.g., the relationship of the size and shape of the body and shade, the height of the lamp source within the shade, and the absence of glare from the light source. The space available under the shade for the light source is restricted by safety considerations and the necessity [of] for avoiding visual "hot spots" on the shade due to proximity to the light source. These aesthetic requirements lead almost universally to the use of a "saddle" supported at the junction of the base and the single up-socket to support a "harp" which in turn supports the shade in the desired location relative to the lamp body and keeps the shade from contacting the light source. Both the nature and the amount of light available from such "Harp System Lamps" is provided by the lamp owner's choice of the bulb installed in the single up-socket.

As shown in the prior art FIG. 1, the typical Harp System Lamp may include an ornamental base 10 from which the electric power cord 12 extends to an electrical receptacle in the wall or floor. An ornamental body 14 cored for the passage of the electrical wiring of the lamp extends upwardly from the base 10 to an upwardly opening Edison screw socket 16 (an "up-socket") for a base-down Edison based bulb 18. The up-socket 16 may include a simple on/off switch 26 but is often a "3-way" socket, i.e., a four position switch that may be manually toggled from an "off" position through a "low" and a "medium" to a "high" light position in which an additional light source such as an additional incandescent filament within the same bulb is energized to provide more light.

A saddle 20 located just below the up-socket 16 removably receives the bottom ends of the legs of a harp 22 that extends upwardly on both sides of the socket 16, bending radially outward around the light source 18 to provide a support for the lamp shade 24 as well as preventing contact of the shade with a bulb 18 in the socket 16. The harp 22 supports the shade 24 at the desired height relative to the lamp body 14 and a finial 23 is used to retain the shade on the harp 22.

The shade 24 laterally surrounds the socket 16 and bulb 18 to diffuse the light and reduce glare. The shade may be in the form of a cylinder (i.e., a "drum" shade), a truncated cone or pyramid, an oval, a rectangle, or a square. While some light may pass through the shade 24, the shade defines openings at the top and the shade is generally reflective. The light emitted by the bulb 18 is generally horizontally omnidirectional and the shade 24 is generally shaped to reflect light through the top opening as area light and through the bottom opening as task light.

The light source 18 historically is a single incandescent bulb received in the up-socket 16. Because the light source is base-down and relatively low in elevation, upright stability for the Harp System Lamp is easily designed into the lamp by the weight and footprint of the base 10.

Adequacy of Available Task Light.

A "lumen" is a measurement of the amount of light produced and a "foot-candle" is a measurement of the light intensity at some defined point. Lumens are thus generally used to indicate the total light output of the light source, and foot-candles are generally used to measure the brightness of the light illuminating a particular workspace or desktop.

Harp System Lamps require a shade to prevent glare and only a very small percentage of the light impinging on the shade passes through it. With common shades, about 25-35 percent of the lumens emitted by the light source pass out of the opening at the top of the shade to be reflected off the room ceiling to provide indirect area light. About 20% of the lumens are absorbed within the shade or are transmitted horizontally through the material of the shade. In general, only about 50% of the total lumens emitted by a base-down bulb exit the opening at the bottom of the shade 24 as task light, with about a third of those lumens provided only when the shape and material of the shade directs light impinging on the shade toward the task area. Despite the small proportion of the total lumens available as task light, Harp System Lamps are widely used as task lights, i.e., to read magazines or newspapers, to do needlework, to play cards, to work with a computer, etc.

Industry sources suggest that 150 to 500 foot candles are needed to perform tasks such as reading, with the difficulty of the task, the age of the person performing the task, and the length of time the task is performed being contributing factors.

The adequacy of the available task light from Harp System Lamps for a specific task is determined by the person using the lamp and there are three factors contributing significantly to that determination for most Harp System Lamp users.

One factor is the base down orientation of the light source in Harp System Lamps. Tests were conducted with a Harp System Lamp having an 9 inch harp and an common ivory translucent "Empire" shade having a 13" top and a 17" bottom, providing a 10" slant height shade sloped at about 20 degrees to the vertical.

With a 60 w incandescent base-down bulb in the Harp System Lamp up-socket, a horizontal task surface was selected about 16.5" below the top of the socket at a radial distance of about 12.5" as the test "Task Site". The light measured on the Test Site was about 22 foot-candles. Even with the historic but now disfavored 100 w incandescent bulb base-down in the Harp System Lamp, the task light on the Task Site was only about 42 foot-candles, i.e. less than half of the minimum foot candles recommended for reading.

A second factor is age. The number of people in the United States age 50 and older has, in the last 30 years, increased to 100 Million and the median age of the population has increased from 33 years to 38 years. People need more light as they age, it being well understood in the medical and scientific communities that people age 50-60 need three times the light they needed in adolescence. People naturally lose about 65% of their visual acuity between age 20 and 60 in addition to developing visual impairments such as presbyopia, macular degeneration, cataracts, and glaucoma. This is the natural deterioration of eyesight with age, and suggests that a mature reader needs at least double the recommended foot candles.

A third factor is a long standing government energy conversation policy encouraging the replacement of incandescent light bulbs with "lumen equivalent" LED and CFL bulbs which last for many years and use less energy, but provide significantly less task light in table and floor lamps.

For example, an incandescent bulb produces 1600 lumens for 100 w, a CFL bulb produces 1600 lumens for 23-28 w, and an LED bulb produces 1600 lumens for 15-20 w. Efforts to match the horizontal "omni-directional" nature of incandescent bulbs have resulted in coiled "compact" or "CFL" fluorescent bulbs and in arrays of light emitting diodes or "LEDs". Such retrofit bulbs substantially outlast incandescent bulbs of the same total lumen output, but generally double the price to the consumer.

Equivalent CFL and LED bulbs are generally sold only by comparison with the total light output from incandescent bulbs, i.e., as "total lumen equivalent" bulbs. For example, a 23 w CFL and a 15 w LED bulb are sold as "equivalent" to a 100 w incandescent bulb. All three bulbs produce a total of about 1600 lumens, but the light emitted from CFL and LED bulbs is asymmetrical when compared to an incandescent bulb, with the light from LED bulbs, depending on the manufacturer, being even more asymmetrical than CFL bulbs because the LEDs themselves are highly directional. Tests show that a significant portion of task light from a lamp using retrofit bulbs is lost to the consumer because of the squelching necessary to diffuse and spread the light from such inherently asymmetrical sources.

Additional tests with the Harp System Lamp referenced supra and a 60 w equivalent CFL base-down bulb (14 w) in the Harp System Lamp socket, the light at the Test Site was measured at about 16 foot-candles as compared with the 22 foot-candles from the 60 w incandescent bulb. With a 100 w equivalent CFL bulb (23 w), the light at the Test Site was measured at about 34 foot-candles as compared with the 42 foot-candles from a 100 w incandescent bulb. Thus, the use of base-down retrofit florescent bulbs in a Harp System Lamp significantly reduces the available task light and is well below the recommended level.

The test results for lumen equivalent LED bulbs are similar. For example, a typical 100 w equivalent LED bulb (15 w) in a base-down configuration produces only 36 foot-candles as compared with the 42 foot-candles from a 100 w incandescent bulb. Thus, the use of base-down retrofit LED bulbs in a Harp System Lamp is also well below the recommended level.

The Present Invention

Among the objects of the present invention is the manual conversion of a single up-socket Harp System Lamp to a plural down-socket LED lighting system which provides materially more and better task lighting without impacting the lamp aesthetics, i.e., four 60 w equivalent LED bulbs (8 w each), produce 150-200 foot-candles at the Test Site which compares very favorably with the 22 foot-candles measured on the Test Site with a single "60 watt equivalent" base down LED or CFL bulb, i.e., 6 to 10 times the task light for one half the power.

The adaptor of the present invention manually screws into the single up-socket of an in-service Harp System Lamp for electrical power, and preserves the aesthetics for which the Harp System Lamp was purchased by permitting the use of the original harp and shade. The conversion provides significantly more energy efficient task light without the space and stability problems expected in any attempt to convert a single base-down lamp to a plural base-up LED bulb lamp.

While the most important functional criteria in the conversion of Harp System Lamps is an increase in the amount of available task light without destroying the aesthetics of the lamp—not the adaptor's manufacturing cost, longevity or power consumption—the adaptor of the present invention is inexpensive to purchase and operate, easily installed by the typical lamp owner without special skills or tools, or changes to the wiring of the Harp System Lamp.

Many other objects and advantages will be apparent from the following detailed description of preferred embodiments when read in conjunction with the appended drawings.

THE DRAWINGS

FIG. 1 referenced supra is a pictorial representation of a typical prior art Harp System Lamp which may be converted into a LED lighting system by the adaptor of the present invention.

DETAILED DESCRIPTION OF PREFERRED EMBODIMENTS

With reference to the appended drawings of preferred embodiments where like numerals have been used for like elements, the present invention addresses the long felt need for more task light out of a Harp System Lamp by the conversion thereof to a plural down-socket LED lighting system.

Figure 1:
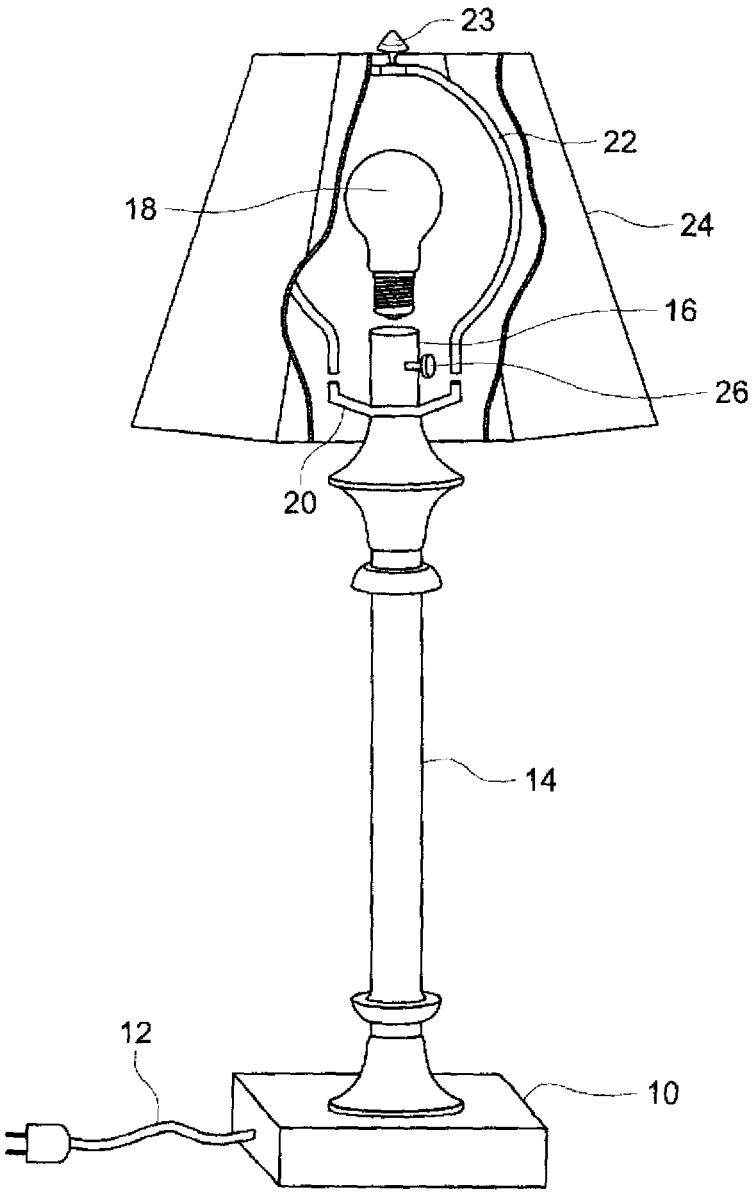
FIG. 1 (PRIOR ART)
Figure 4:
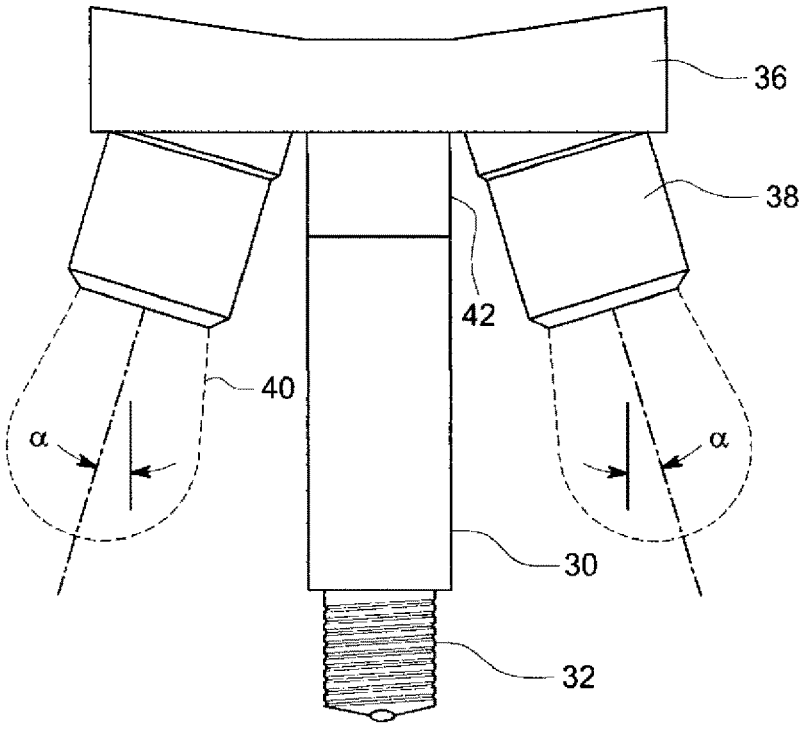
FIG. 4 is a front elevation of the embodiment of FIG. 2.
Figure 5:
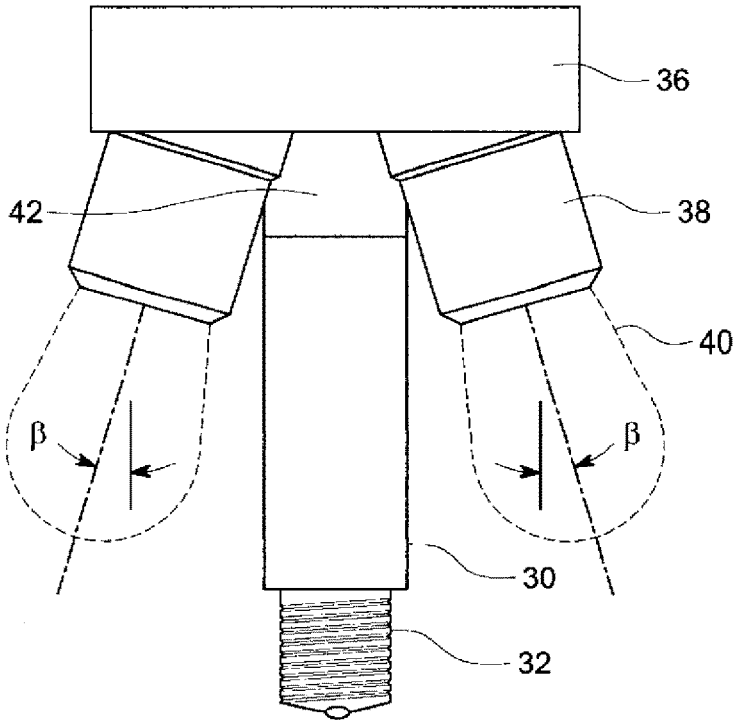
FIG. 5 is a left side elevation of the embodiment of FIG. 2.
Figure 6:
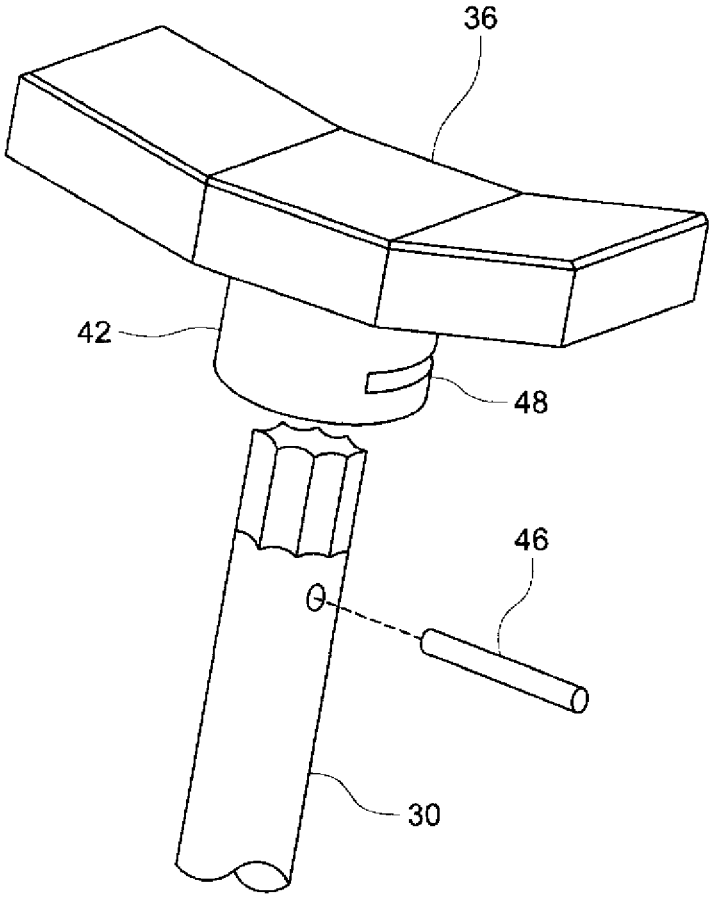
FIG. 6 is a pictorial representation of one embodiment of the connection between the column and socket holder of FIGS. 2-5 which facilitates non-interfering installation of the adaptor.

An exemplary four-bulb embodiment is illustrated in FIGS. 2-5 and an exemplary two-bulb embodiment in illustrated in FIG. 6. With general reference to the figures, the adaptor comprises a column 30 terminating at the lower end in a male Edison screw socket connector 32 adapted for mechanical and electrical connection to the socket 16 of the prior art Harp System Lamp shown in FIG. 1. The column 30 may be telescoping of otherwise selectively adjustable in height in any suitable conventional manner to adjust the height of the light source 34 relative to the shade 24. It has been found desirable for the column 30 to be between about 5 and 7 inches, and thus for the vertical adjustment to be about 2 inches.

Carried at the upper end of the column 30 is a generally horizontal socket support 36 which has four down-sockets 38 each adapted to receive a suitable conventional LED light bulb 40. Any number of down-sockets 2 may be used consistent with the teachings hereof.

As shown in FIGS. 2-5, the down-sockets are desirably at an angle $\alpha$ to the vertical, at least about 5 degrees away from the plane of the harp 22. The down-sockets may also be at an angle $\beta$ at least about 5 degrees away from a plane parallel to the plane of the harp 22. The angles are important because the inherently directional LEDs used in the bulbs direct more light toward the distal end of the bulbs, desirably away from the axis of the lamp toward the task area.

Figure 2:
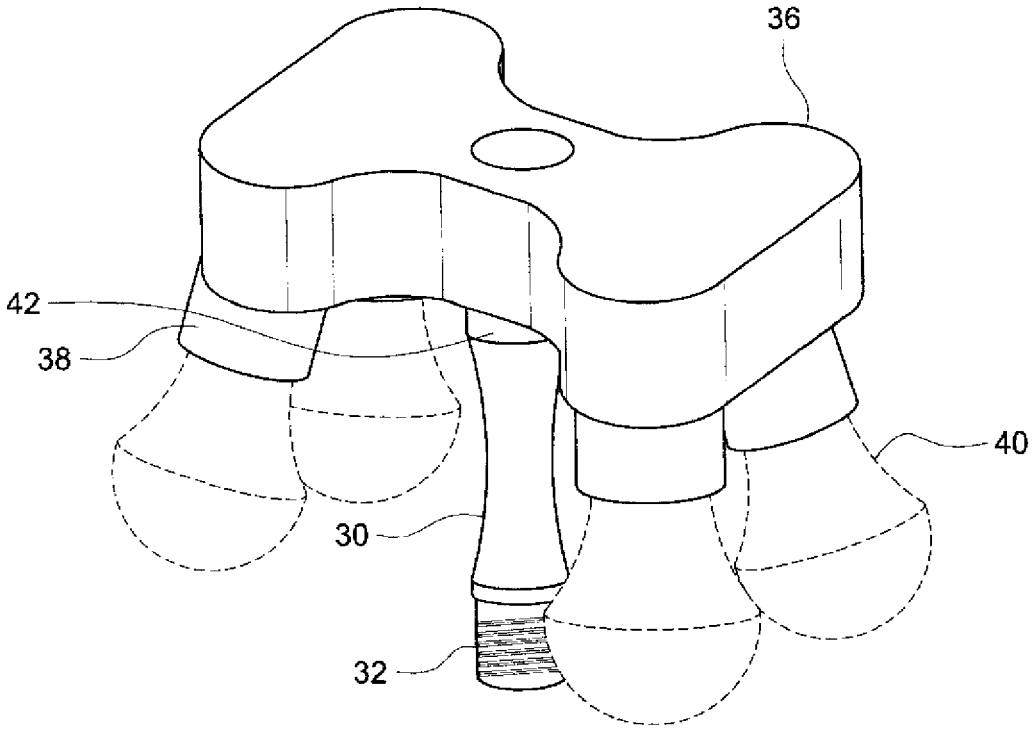
FIG. 2 is a pictorial representation of one embodiment of the adaptor of the present invention provided with four LED bulbs as the light source.
Figure 3:
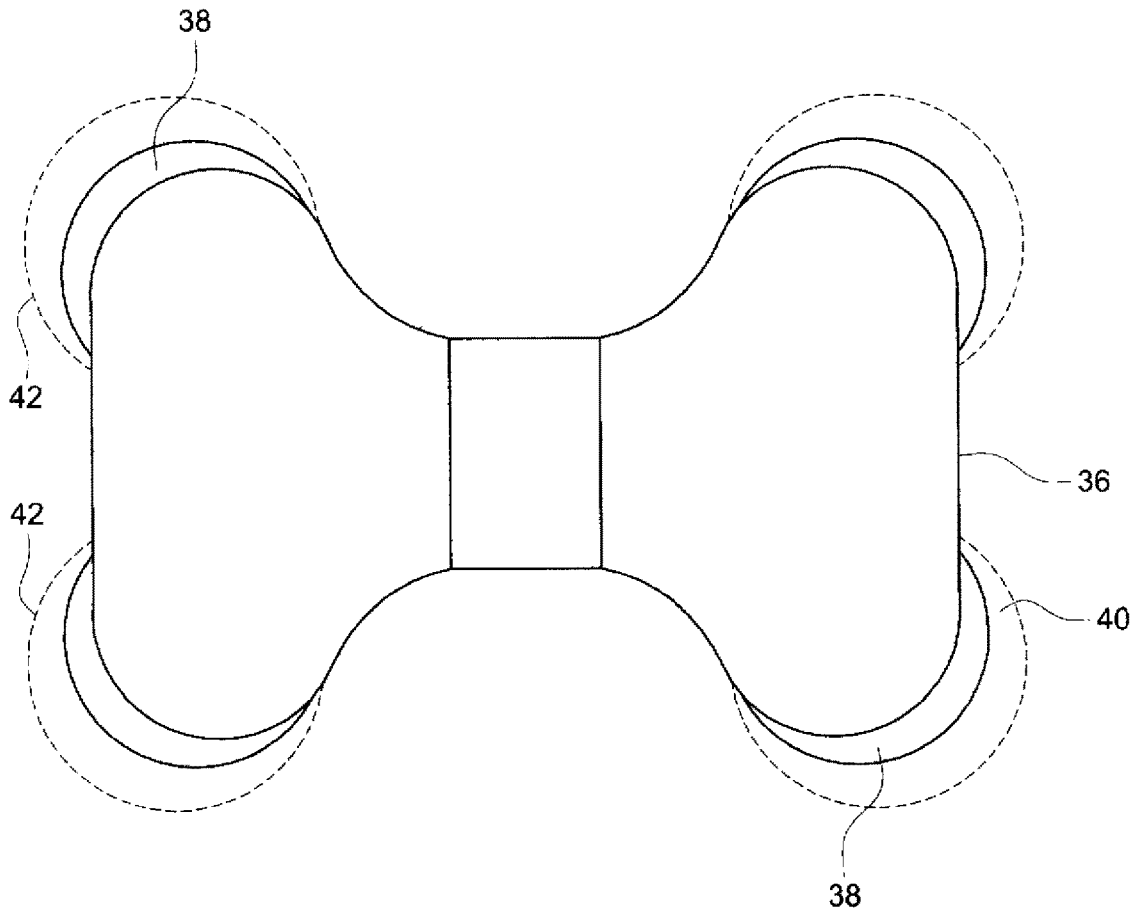
FIG. 3 is a top plan view of the embodiment of FIG. 2.

As shown in the embodiments of FIGS. 2-3, compared to the width at lamp center, the socket support 36 is preferably about twice as wide horizontally adjacent the distal ends thereof than it is adjacent the central axis of the lamp where there is limited spacing between the legs of the harp 22.

The maximum horizontal dimension of the socket holder 36 is necessarily greater than the maximum spacing between the legs of the installed harp 22 but not greater than about 6.5 inches to avoid proximity to the shade 24.

The orientation of the adaptor relative to the Harp System Lamp is not shown in FIGS. 2-5. However, the angular position of the saddle 20, and thus the harp 22, are fixed relative to the socket 16 of a Harp System Lamp. In screwing a laterally symmetrical light bulb into the socket 16 radially internally of the harp 22, the final rotative position of the Edison base 32 of the bulb relative to the plane of the harp 22 is unknown and immaterial. However, where, as here, the socket support 36 extends radially outside the legs of the harp 22, the socket support 36 must be operatively located in a non-interfering position relative to the harp 22.

Because the final rotative position of the base 32 of the adaptor in the socket 16 of the Harp System Lamp is unknown in advance, it is necessary to fix the rotative position of the base 32 of the adaptor relative to the saddle 20 (and thus the harp 22), and to then adjust the rotative position of the socket support 36 relative to the installed base 32.

As shown in FIGS. 2, 4 and 5, the socket support 36 is attached to the column 30 by a rotatable connection 42. As explained infra in connection with FIG. 6, limited rotation between the column 30 and the socket support 36 is required to avoid the possibility of interference with the harp 22. The rotatable connection 42 may be any suitable conventional connection and may be located at the upper or lower ends of the column 30 or intermediate its length.

By way of example only, FIG. 6 illustrates a column 30 having a fluted or grooved upper end that mates with internal flutes in the rotatable connection 42 in any one of several angular positions and a pin 46 may be inserted through a slot 48 to secure the socket support 36 to the column 30.

The socket support 36 may be permanently secured to the column 30 in the manufacturing process to form a T-shaped adaptor. Because the horizontal dimension of the socket support 36 is greater than the spacing between the legs of the harp 2, the harp 22 must be removed from the Harp System Lamp in order to rotate the unitary T-shaped adaptor into a secure mechanical and electrical position in the up-socket 16. After installation of the adaptor, and the rotation of the plural light sources 40 to the desired non-interfering position with respect to the saddle 20, the harp 22 may reinstalled in the saddle 20.

However, where the socket support 36 is separable from the column 30, the removal of the harp 22 from the Harp System Lamp is not necessary. By way of example only, the column 30 may be rotatively installed in the socket 16, and the socket support 36 thereafter positioned normal to the plane of the harp 22 vertically over the column 30 and snapped downwardly in place.

In both cases, some degree of after-installation rotation is desirable and may be provided by any suitable conventional mechanism.

Figure 7:
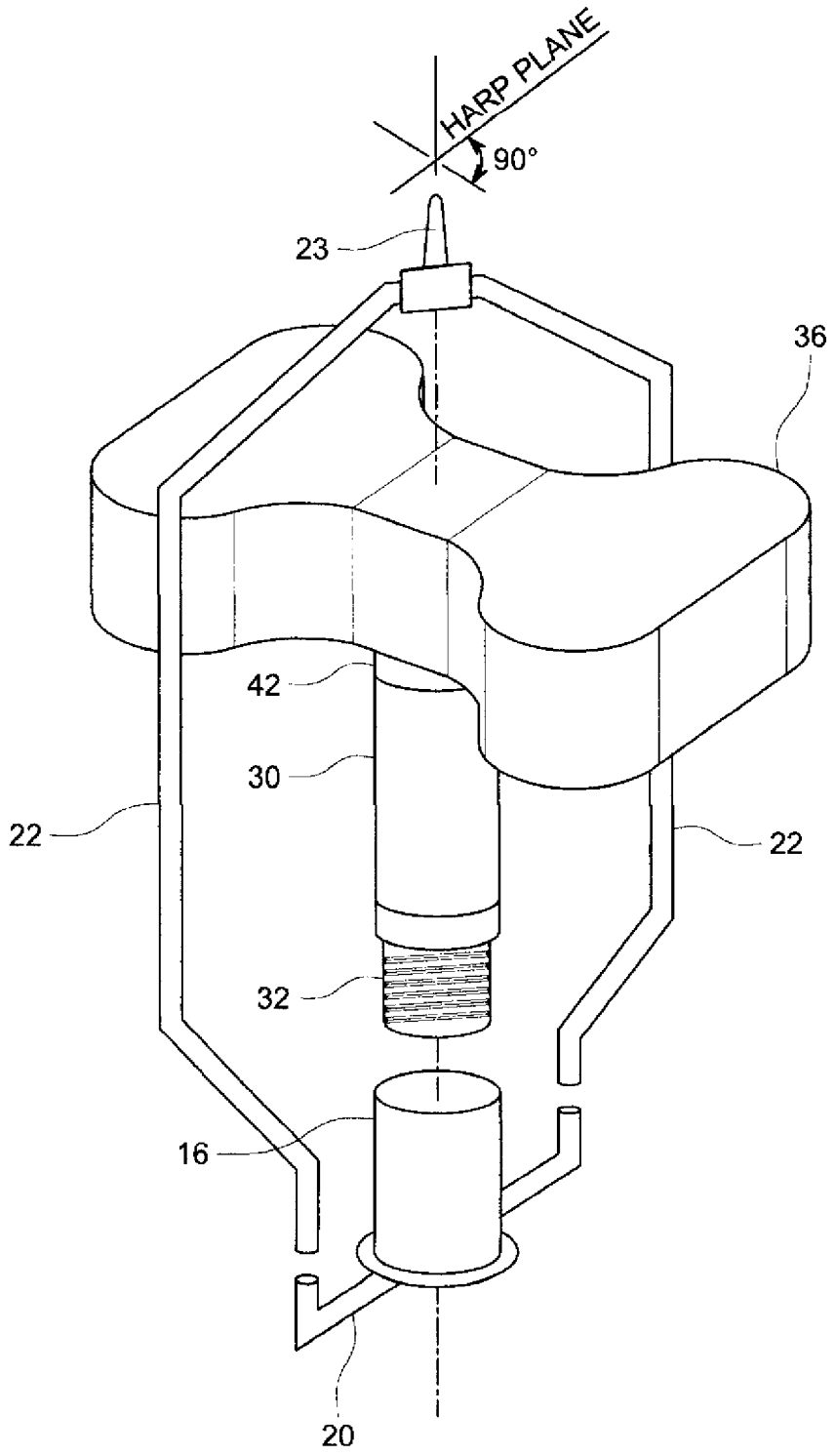
FIG. 7 is a pictorial representation of the preferable non-interfering location of the adaptor relative to the plane of the harp.

As shown in the "dog bone" embodiment of FIG. 7, the most desirable rotative position for the socket support 36 is approximately 90 degrees to the plane passing through the harp 20 when installed in the saddle 20.

The Edison based LED bulbs screwed into the plural down-sockets 38 may be any suitable commercially available LED bulbs. The advantages of multiple bulbs in a base-up orientation are readily apparent for task light, and these advantages are enhanced by the directive nature of the LED bulbs, essentially reversing the percentages of light emitted upwardly and downwardly from the converted Harp System Lamp. The relatively new filament LED bulbs are advantageous in that the light therefrom is generally more diffuse and softer.

While the foregoing is a description of preferred embodiments, many variations and modifications will naturally occur to those of skill in this art from a perusal hereof.

Advantages and Scope of Invention

The advantages of the present invention are readily apparent to one of skill in this art and the invention is not to be limited to the disclosed embodiments, but defined only by the claims when accorded a full range of equivalents.

The conversion of a Harp System Lamp to a LED lighting system by installation of the claimed module may be made manually, without tools. No changes in the electrical circuit of the Harp System Lamp are required and so the Harp System Lamp owner does not have to have special skills or tools to effect the conversion.

The amount of task light is materially increased by bulb inversion. After installation of the four bulb embodiment described above in connection with FIGS. 2-5 and the insertion of four 60 w equivalent LED bulbs (8 w each), 150-200 foot-candles were measured at the Test Site. This compares very favorably with the 22 foot-candles measured on the Test Site with a single "60 watt equivalent" base down LED or CFL, i.e., 6 to 9 times the task light for one half the power.

The increase in the number of bulbs effectively spreads and diffuses the light source. The inversion of the bulbs effectively lowers the light source within the shade about 2 to 4 inches, which enlarges the task area receiving direct illumination through the lower opening in the shade, as does the angles of the bulbs relative to the vertical. The angle of the bulbs takes on increased significance depending on the shape of the shade, i.e., the currently popular drum shades reflect relatively little horizontally emitted light downwardly. The lateral displacement of the bulbs from lamp center also effects diffusion.

For the visually impaired needing unusually high light levels, multiple down-sockets are highly advantageous in that specialty bulbs may be selected for specific sockets to increase the foot-candles in the area illuminated by that socket. A single parabolic aluminized reflector ("PAR") bulb (8 w) inserted in just one socket can significantly increase the task light in one area under the shade, e.g., to 300 foot-candles.

The heat source of LED bulbs is adjacent the base thereof whereas the heat associated with an incandescent bulb is associated with the filaments. The position of the heat is lowered by bulb inversion to what is generally the wider part of the shade and may be moderated and diffused in the present invention by the use of thermal socket covers.

Importantly, the aesthetics of the lamp, i.e., the appearance of the body and shade, are not changed by the conversion. The lamp shade is retained and remains at the same relative position to the body because the shade support system (i.e., saddle and harp) are retained in their original location relative to the body.

What is claimed is:

1. A conversion kit for a portable lamp having: a body, a saddle proximate to the upper end of said body, a harp carried by said saddle in a near vertical plane, the maximum horizontal distance between the legs of said harp being above said up-socket, a shade defining upper and lower openings supported by said harp, and a single up-socket carried by said body vertically above said saddle, said up-socket being adapted to receive a screw-in light source, said kit comprising:

a vertical column having a downwardly extending male Edison screw connector at the lower end thereof for operatively connecting with said up-socket;

a plurality of down-sockets each adapted to receive an LED light source;

a generally horizontal socket support member carried by said column proximate the upper end thereof for supporting said plurality of down-sockets, said socket support member having a maximum horizontal dimension greater than the maximum horizontal distance between the legs of said harp when supported by said saddle;

a connector located between said socket support member and said screw connector for selectively varying the rotative position of said socket support member relative to said screw connector so that said socket support member can be positioned with the maximum horizontal dimension thereof rotated to a position about 90 degrees from the plane of said saddle for each of a number of different operative rotative positions of said screw connector in said up-socket to thereby avoid interference between said socket support member and said harp; and an electrical connection passing interiorly of said column for selectively applying electrical power from said screw connector to said plurality of down-sockets.

2. The conversion kit of claim 1 wherein said column and said socket support member are integral.

3. The conversion kit of claim 1 wherein said socket support member is removably attached to said column.

4. The conversion kit of claim 1 including plural LED light sources adapted to be received in one of said down-sockets.

5. The conversion kit of claim 4 wherein said plural LED light sources are filament LED bulbs.

6. The conversion kit of claim 4 wherein said plural LED light sources are LED bulbs.

7. The conversion kit of claim 1 wherein said connector is located intermediate the upper and lower ends of said column.

8. The conversion kit of claim 1 wherein said connector is located proximate to the junction of said column and said base.

9. The conversion kit of claim 1 wherein said connector is located proximate to said socket support member.

10. The conversion kit of claim 1 wherein the number of said down-sockets is four.

11. The conversion kit of claim 1 wherein said down-sockets are angled at least 5 degrees away from the plane of said harp.

12. The conversion kit of claim 11 wherein said down-sockets are angled at least 5 degrees away from said column in a plane parallel to the plane of said harp.

13. The conversion kit of claim 1 wherein said down-sockets are angled at least 5 degrees away from said column in a plane parallel to said harp.

14. The conversion kit of claim 1 where the maximum horizontal dimension of said socket support member is less than about 6.5 inches.

15. The conversion kit of claim 1 where the horizontal dimension of said socket support member normal to the maximum length of said socket support member proximate to said column is less than the horizontal dimension of said socket support member normal to the maximum length of said socket support member at the distal ends thereof.

16. The conversion kit of claim 1 wherein the vertical height of said socket member proximate to said column is less than the vertical height of said socket member at the distal ends thereof.

17. The conversion kit of claim 1 wherein the maximum length of said column is between about 5 inches and about 7 inches.

18. The conversion kit of claim 17 wherein the length of said column is adjustable between about 4 inches and about 7 inches.

19. The conversion kit of claim 1 wherein each of said down-sockets includes a heat sink.

20. The conversion kit of claim 1 wherein said plural down-sockets are individually controlled.

21. An adaptor for converting a single up-socket portable lamp having a shade and a shade support system to a plural down-socket portable lamp without the necessity of changing the shade or the shade support system for the lamp comprising:

a vertical column having a downwardly extending male Edison screw connector at the lower end thereof for operatively connecting with the up-socket of the portable lamp to be converted;

a generally horizontal socket support member carried by said column proximate the upper end thereof, said support member having a maximum horizontal dimension between about 4 and about 7 inches;

a plurality of down-sockets carried by said support member; and a rotator for selectively varying the rotative position of said socket support member relative to said Edison screw connector.

22. In a lamp having a body, a single up-socket, a shade, a harp for supporting said shade, and a saddle for supporting said harp, a method of converting the up-socket to plural down-sockets comprising the steps of:

a. providing a T-shaped adapter (i) having a base configured to operatively connect with the up-socket and a crosspiece including plural down-sockets, (ii) having a maximum horizontal dimension greater than the maximum horizontal spacing between the legs of the harp, and (iii) being selectively rotatable relative to the base;

b. operatively connecting the base of the adapter in the up-socket; and c. thereafter selectively rotating the crosspiece relative to the base to position the crosspiece generally normal to the plane of the harp to thereby reduce interference between said harp and said adapter.

23. A method of converting a lamp having a body, a saddle, an up-socket, a harp, and a shade to a lamp having plural down-sockets comprising the steps of:

a. providing a T-shaped adapter with a base configured to operatively connect with the up-socket and with plural down-sockets depending from the T-shaped adaptor;

b. removing the shade, harp and light bulb from the lamp;

c. installing the T-shaped adapter in the up-socket of the lamp;

d. selectively rotating the T-shaped adaptor generally normal to the plane of said saddle independently of an operative rotational position of the base in the up-socket; and e. reinstalling the harp and the shade.

24. The conversion kit of claim 1 wherein the number of said down-sockets is four and including plural LED light bulbs adapted to be received in at least two of said down-sockets.

25. The conversion kit of claim 24 wherein said down-sockets are angled away from the plane of said harp and away from said column in a plane parallel to the plane of said harp.

26. The conversion kit of claim 24 wherein at least two of said four down-sockets are controlled as a unit.

27. The conversion kit of claim 1 wherein said down-sockets are angled away from the plane of said harp and away from said column in a plane parallel to the plane of said harp.

28. An adaptor for converting a single up-socket portable lamp having a shade and a shade support system to a plural down-socket portable lamp comprising:

a vertical column having a downwardly extending male Edison screw connector at the lower end thereof for operatively connecting with the up-socket of the portable lamp to be converted; a plurality of down-sockets carried by said column proximate the upper end thereof at generally the same vertical distance above said up-socket, said plurality of down-sockets having a maximum horizontal dimension (a) between about 4 and about 7 inches and (b) more than the maximum horizontal spacing of said shade support system.

29. An adaptor for converting (a) a single up-socket portable lamp having (i) a shade and (ii) a harp for supporting said shade to (b) a plural down-socket portable lamp comprising:

a vertical column having a downwardly extending screw connector at the lower end thereof for operatively connecting with the single up-socket of the portable lamp to be converted; a plurality of down-sockets carried by said column proximate the upper end thereof at generally the same vertical distance above said up-socket, said plurality of down-sockets having a maximum horizontal dimension (a) more than the maximum horizontal spacing of said harp.

30. The adaptor of claim 29 including a selectively rotatable connector intermediate said screw connector and said down-sockets for selectively adjusting the relative rotation between said screw connector and said down-sockets after said screw socket is operatively connected with said up-socket.

31. In a lamp having a body, an up-socket, a shade, a harp for supporting said shade, and a saddle for supporting said harp, a method of converting the up-socket to plural down-sockets comprising the steps of:

a. providing an elongated support (i) having at the lower end thereof a base configured to operatively connect with the up-socket and having at the upper end thereof plural down-sockets, and (ii) having a maximum horizontal dimension greater than the maximum horizontal spacing between the legs of the harp when supporting the shade;

b. operatively connecting the base in the up-socket; and c. thereafter selectively adjusting the rotative position of the maximum horizontal dimension of the support relative to the harp to thereby reduce interference between the elongated support and the harp.

32. An adaptor for converting (a) a single up-socket portable lamp having (i) a shade and (ii) a harp for supporting said shade to (b) a plural down-socket portable lamp comprising:

a vertical column having a downwardly extending screw connector at the lower end thereof for operatively connecting with the single up-socket of the portable lamp to be converted;

a plurality of down-sockets carried by said column proximate the upper end thereof; and a selectively rotatable connector intermediate said screw connector and said down-sockets for selectively adjusting the relative rotation between said screw connector and said down-sockets after said screw socket is operatively connected with said up-socket.

33. The adaptor of claim 32 wherein the number of said down-sockets is four;

wherein said down-sockets are carried by said column at approximately the same height above said up-socket; and wherein the horizontal dimension across alternate ones of said four down-sockets is substantially the same.

* * * * *